US006571870B2

(12) United States Patent
Zheng et al.

(10) Patent No.: US 6,571,870 B2
(45) Date of Patent: Jun. 3, 2003

(54) METHOD AND APPARATUS TO VIBRATE A DOWNHOLE COMPONENT

(75) Inventors: Shunfeng Zheng, Houston, TX (US); Benjamin P. Jeffryes, Cambs (GB); Hubertus V. Thomeer, Houston, TX (US); Lawrence J. Leising, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 56 days.

(21) Appl. No.: 09/797,157

(22) Filed: Mar. 1, 2001

(65) Prior Publication Data

US 2002/0121378 A1 Sep. 5, 2002

(51) Int. Cl.[7] ..... E21B 31/113

(52) U.S. Cl. ..... 166/178; 166/177.6; 175/297; 175/299

(58) Field of Search ..... 175/293, 296, 175/297, 299; 166/249, 178, 196, 177.6

(56) References Cited

U.S. PATENT DOCUMENTS

| | | | | |
|---|---|---|---|---|
| 3,361,220 A | | 1/1968 | Brown | |
| 3,570,611 A | * | 3/1971 | Rizuic | 175/296 |
| 3,946,819 A | | 3/1976 | Hipp | |
| 4,462,471 A | | 7/1984 | Hipp | |
| 4,747,466 A | | 5/1988 | Jaworski | |
| 4,890,682 A | * | 1/1990 | Worrall et al. | 175/61 |
| 4,958,691 A | | 9/1990 | Hipp | |
| 5,803,182 A | * | 9/1998 | Bakke | 173/91 |
| 5,871,277 A | | 2/1999 | Lash | |
| 5,957,220 A | * | 9/1999 | Coffman et al. | 173/91 |
| 5,997,172 A | | 12/1999 | Wakabayashi | |
| 6,009,047 A | | 12/1999 | Barger | |
| 6,009,948 A | | 1/2000 | Flanders et al. | |
| 6,012,521 A | | 1/2000 | Zunkel et al. | |
| 6,062,324 A | * | 5/2000 | Hipp | 175/296 |

FOREIGN PATENT DOCUMENTS

| | | | |
|---|---|---|---|
| DE | 4109215 A1 | * | 9/1992 |
| EP | 0333484 A2 | * | 9/1989 |
| EP | 0 443 689 A2 | | 8/1991 |
| WO | WO 97/46787 | | 12/1997 |

OTHER PUBLICATIONS

Kjell–Inge Sola and Bjornar Lund, New Downhole Tool for Coiled Tubing Extended Reach, paper presented at the 2000 SPE/CoTA Coiled Rubing Roundtable, Houston, TX Apr. 5–6, 2000 (Society of Petroleum Engineers Inc.).

* cited by examiner

*Primary Examiner*—David Bagnell
*Assistant Examiner*—Zakiya Walker
(74) *Attorney, Agent, or Firm*—Wayne I. Kanak; Brigitte L. Jeffery; John J. Ryberg

(57) ABSTRACT

An apparatus for use in a wellbore comprises a housing having a longitudinal axis and a mechanism having one or more impact elements adapted to move along the longitudinal axis in an oscillating manner to impart a back and forth force on the housing to vibrate the housing. In another arrangement, an apparatus for use in a wellbore comprises a housing and at least one impact element rotatably mounted in the housing. The at least one impact element is rotatable to oscillate back and forth to impart a vibration force to the housing.

23 Claims, 9 Drawing Sheets

METHOD AND APPARATUS TO VIBRATE A DOWNHOLE COMPONENT

TECHNICAL FIELD

The invention relates to method and apparatus to vibrate a downhole component.

BACKGROUND

To prepare a well for production of hydrocarbons, various operations are performed, including drilling and completion operations. In drilling a well, a drill bit is carried on the end of a drill pipe. In completing a well, various operations may be performed by carrying tools down on a tubing string (e.g., a coiled tubing or jointed tubing). As used here, the term "tubing string" is used to denote a rigid conveyance mechanism or structure, such as a coiled tubing or drill pipe, that can be used to carry tools or fluids into a wellbore.

More recently, many deviated or extended reach wells have been drilled to facilitate the recovery of hydrocarbons. Extended reach wells have proven to be able to increase the recovery rate of hydrocarbons while reducing the operational cost. Generally, the deeper an extended reach well can be drilled or serviced, the higher the economic benefit. Despite many technical advances in the area of extended reach technology, challenges remain in drilling or servicing extended reach wells.

For a given extended or deviated well, the reach of a tool carried on a tubing string is limited by the propensity of the tubing string to lock up. As a tubing string is run into a wellbore, it has to overcome the frictional force between the tubing string and the wall of the wellbore. The longer the length of the tubing string that is run into the wellbore, the greater the frictional force that is developed between the tubing string and the wellbore wall. When the frictional force becomes large enough, it will cause the tubing string to buckle, first into a sinusoidal shape and then into a helical shape. After helical buckling occurs, continuing to run the tubing string into the wellbore will eventually lead to a stage where further pushing of the tubing string will not result in further advancement of the tubing string. Such a stage is referred to as tubing string lockup. The depth of tubing string lockup defines the maximum depth a tool or fluid can be delivered in the well.

Various factors affect (directly or indirectly) the maximum depth that a tubing string can be run into a wellbore. One factor is the friction coefficient between the tubing string and the wellbore. Another factor is the normal contact force between the tubing string and the wellbore, which is dependent on the weight of the tubing string and the stiffness of the tubing string. Generally, a lower friction coefficient or lower tubing string weight usually indicates that the tubing string can extend further into the wellbore. Also, higher bending stiffness tends to delay the occurrence of buckling, which extends the reach of the tubing string into the wellbore.

Various solutions have been attempted or implemented to extend the reach of a tubing string in a wellbore. One is to reduce the contact force between the tubing and the wellbore, such as by using different fluids inside and outside the tubing to reduce the buoyancy weight of the tubing or by using a more light-weight material for the tubing. Another technique is to delay or prevent the onset of helical buckling, which can be achieved by using larger diameter tubing. However, this increases the weight of the string and reduces flexibility in operation. Yet another approach uses a tractor to pull tubing into the well by applying a tractor load at the lower end of the tubing. Other approaches employ vibration to aid in friction reduction.

However, despite the various solutions that have been proposed or implemented, a need continues to exist for an improved method and apparatus to improve the reach of a string in a wellbore.

SUMMARY

In general, according to one embodiment, an apparatus for use in a wellbore comprises a housing having a longitudinal axis and a mechanism having one or more impact elements adapted to move along the longitudinal axis in an oscillating manner to impart a back and forth force on the housing to vibrate the housing.

In general, according to another embodiment, an apparatus for use in a wellbore comprises a housing and at least one impact element rotatably mounted in the housing. The at least one impact element is rotatable to oscillate back and forth to impart a vibration force to the housing.

Other or alternative features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. Although described embodiments refer to vibration apparatus and methods for enhancing drilling or other services in extended reach or deviated wells, the same or modified vibration apparatus and method can be used in other applications, such as freeing stuck pipe, assisting the installation of a liner, placement of sand control screens, activating downhole mechanisms (e.g., valves, nipples, etc.), and other applications.

As used here, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
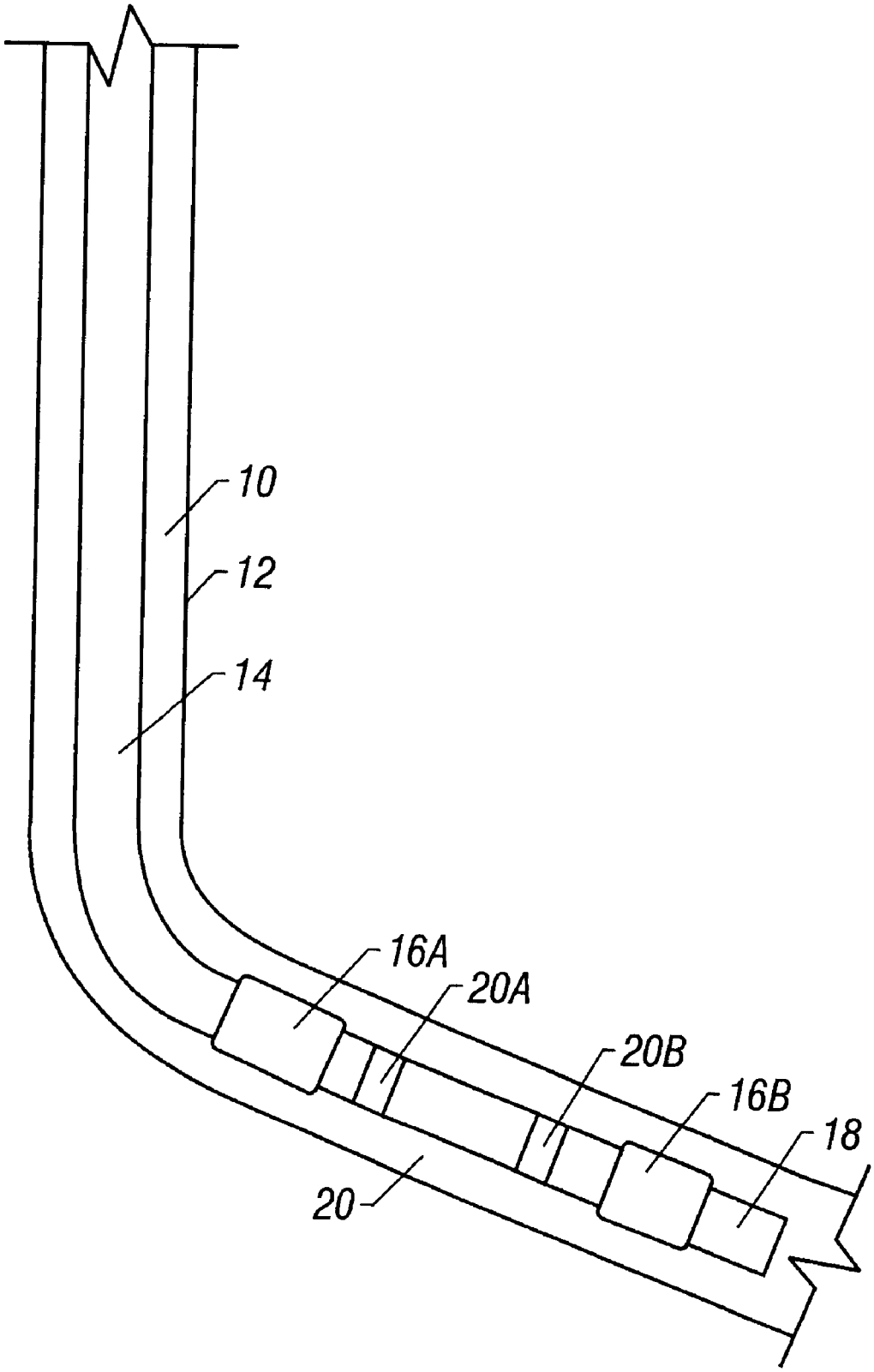
FIG. 1 illustrates an embodiment of a tool attached to a conveyance or carrier structure in a wellbore, the conveyance or carrier structure including one or more vibration devices.

Referring to FIG. 1, a string includes a tool 18 carried on a tubing or pipe 14 (hereinafter referred to as "tubing" or "tubular conduit" or "tubular structure") into a wellbore 10. In another embodiment, the structure that carries the tool 18 into the wellbore does not need to be tubular, but rather can be any other shape that is suitable for use in the wellbore as a rigid carrier structure. As used here, a carrier structure is considered to be "rigid" if a compressive force can be applied at one end of the carrier structure to move it downwardly into the wellbore. A rigid carrier structure is contrasted to non-rigid carrier structures such as wirelines or slicklines.

The wellbore 10 is lined with a casing 12, and has a generally vertical section as well as a deviated or horizontal section 20. In other embodiments, the wellbore 10 can be a generally vertical well, a deviated well, or a horizontal well.

In accordance with some embodiments of the invention, one or more vibration devices 16 are mounted on the string. In the illustrated example of FIG. 1, two vibration devices 16A and 16B are illustrated. In other examples, a single vibration device or more than two vibration devices can be used.

In one embodiment, the vibration device includes one or more impact elements that are able to oscillate back and forth along a longitudinal axis of the string to impart a back and forth force on the string. The back and forth forces applied by the one or more impact elements in the vibration device causes vibration along other portions of the string. Alternatively, instead of b-idirectional repeated impacts, the impacts may occur only in a single direction to provide unidirectional impacts. In another embodiment, instead of longitudinal oscillation of the impact elements in the vibration device 16, the one or more impact elements can be rotatably mounted in a housing of the vibration device to oscillate in a rotational back and forth manner to impart a rotational or torsional vibration force on the tubing string.

Thus, in the first embodiment, longitudinal vibration (due to bi-directional or unidirectional impacts) is introduced on the tubing string, while in the second embodiment, rotational or torsional vibration (due to bi-directional or unidirectional rotational impacts) is imparted on the tubing string. Longitudinal vibrations and rotational vibrations are able to reduce the frictional force between the tubing string and the wellbore wall. In yet another embodiment, both longitudinal and rotational vibration devices can be used in combination with a single tubing string.

In accordance with some embodiments of the invention, the bi-directional or unidirectional impact oscillation can be achieved without the need of tension or compression on the tubing string. In other words, an upward force applied on the tubing string or a compression force applied on the tubing string is not needed for operation of the vibration device 16. In one embodiment, the energy to actuate the back-and-forth axial oscillation is provided by fluid pressures. In other embodiments, other types of energy can be used, such as electrical energy. The mechanism to actuate the vibration device 16 operates independently of any tension or compression force applied to the string, in accordance with some embodiments.

Generally, the mechanism to operate the vibration device actuates at least one impact element to repeatedly create a longitudinal or rotational jarring force (at generally a given frequency) on a housing of the vibration device. The jarring force can be bi-directional or unidirectional.

Although tension or compression on the tubing string is not needed for operation of the vibration device in some embodiments, other embodiments may employ tension or compression forces to enable actuation of the vibration device, particularly to generate uni-directional, oscillation impact forces.

When longitudinal vibration is introduced in a tubing string, the velocity of the vibration may be superimposed on the translational velocity (the velocity of the tubing string as it is being run into the wellbore). As long as the vibration velocity is larger than that of the running speed of the tubing string, at any instantaneous moment, some portions of the tubing string will have velocity in one direction while other portions of the tubing string will have velocity in the opposite direction. As a result, the frictional force on the tubing string will be in one direction for some portions of the string and in the opposite direction for other portions of the string. Consequently, the overall frictional force between the string and the wellbore wall is reduced, enabling the tubing string to be run deeper into the wellbore. In addition to the frictional benefits offered by the introduced vibration, the motion imparted by the vibration device also aids in extending the reach of the tubing string into the wellbore.

The frequency of vibration can be selected based on the characteristics of the tubing string and the well 10. For example, the length of the deviated or horizontal section 20 of the well and the corresponding tubing string may dictate the vibration frequency and peak impact forces to be imparted by the vibration devices 16. Generally, the longer the deviated or horizontal section 20, the greater the vibration forces needed to extend the reach of the tubing string. The vibration frequency and magnitude may be controlled to provide effective extended reach characteristics while avoiding excessive vibrations that may cause damage to instruments or other tools attached to the tubing string. The frequency of oscillation of the impact element(s) in the vibration device can be selected to match the resonance frequency and/or maximize the transmissibility of the tubing string or to maximize the transmissibility of vibration along the tubing string.

Shock absorbers 20A, 20B (FIG. 1) may also be positioned to protect instruments or other tools in the tubing string that may be damaged by vibration caused by the vibration devices 16.

Figure 2A:
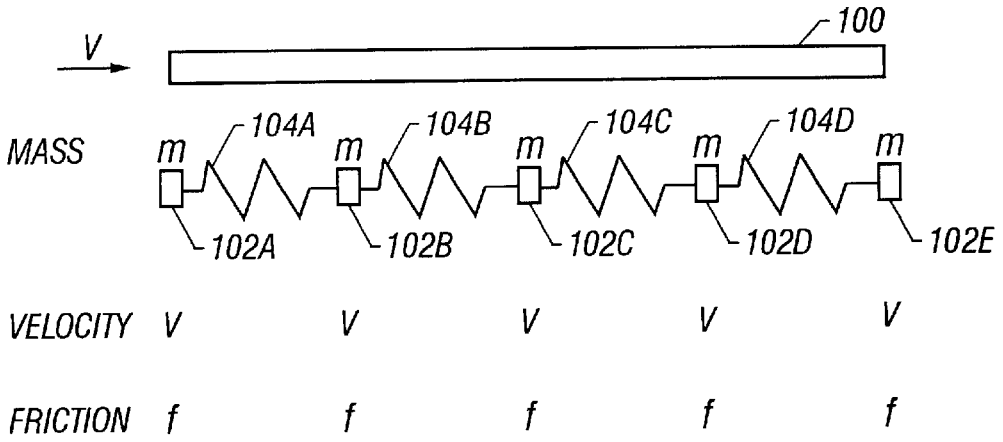
FIGS. 2A–2C illustrate the effect of longitudinal vibration caused by the vibration device according to one embodiment.

The effect of longitudinal vibration on a tubing string is illustrated in connection with FIGS. 2A–2C. In FIG. 2A, a structure 100 that is run into the wellbore at velocity V is illustrated. The structure 100 can be represented as a number (5 in the illustrated example) of masses 102A, 102B, 102C, 102D, and 102E that are connected by respective springs 104A, 104B, 104C, and 104D. Without vibration, the velocity of each of the masses is substantially equal (with the velocity represented as V). The frictional force at each mass 102 is also substantially equal (with the frictional force represented as f). As a result, the net frictional force on the structure 100 in the example of FIG. 2A is +5f, the direction of this frictional force being in the opposite direction of the velocity V.

If longitudinal vibration is applied, then the velocities at different masses 102A–102E will be different. FIG. 2B illustrates the velocity pattern at each mass at an instantaneous moment in time. The velocity at mass 102A is −5V, at mass 102B −3V, at mass 102C 0V, at mass 102D +3V, and at mass 102E +5V. The longitudinal vibration is applied while the tubing string is being run at velocity V, as shown in FIG. 2A. The resulting velocity pattern on the tubing string is the superposition of the translational velocity V (FIG. 2A) and the instantaneous vibration velocity (FIG. 2B), as discussed below.

Figure 2B:
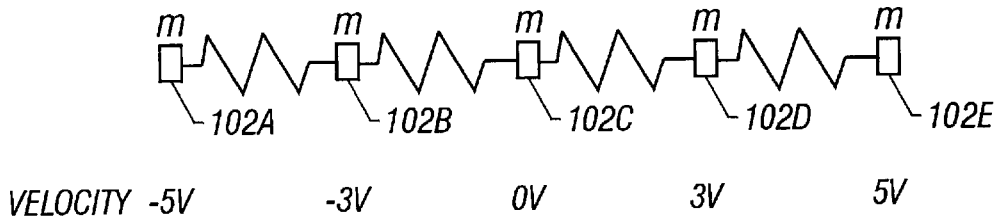
Figure 2C:
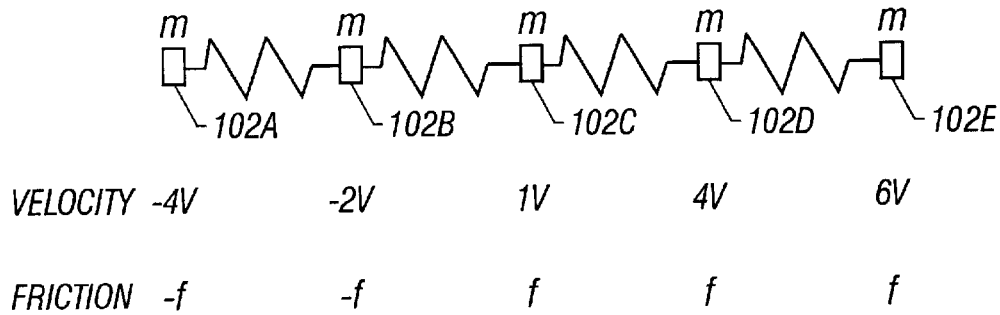

As shown in FIG. 2C, by superimposing the velocity patterns of FIGS. 2A and 2B, the net velocity at mass 102A is −4V, at mass 102B −2V, at mass 102C +1V, at mass 102D +4V, and at mass 102E +6V. At the masses where the velocities are in the negative direction, the frictional forces are also negative (from left to right in the diagram). Thus, at 102A and 102B, the frictional force is −f. On the other hand, at masses where the velocities are in the positive direction, the resulting frictional forces are positive (from right to left in the diagram). The frictional force at each mass is shown in FIG. 2C. As a result, the net frictional force in this arrangement is approximately +f, as compared to the +5f when longitudinal vibration is not applied (FIG. 2A).

As seen from the illustration of FIGS. 2A–2C, for longitudinal vibration to reduce frictional force, the peak vibration velocity should be higher than the translational speed of the tubing string as it is being run into the wellbore. The higher the peak vibration velocity over the translational velocity, the greater the friction reduction.

Figure 3:
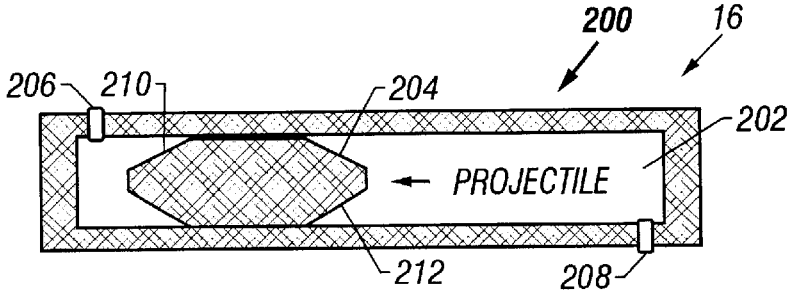
FIG. 3 illustrates generally a vibration device for creating a bi-directional longitudinal vibration.

Referring to FIG. 3, a vibration device 16 according to one embodiment for imparting longitudinal vibration is illustrated. Generally, the vibration device 16 includes a housing 200 that defines a chamber 202. A projectile 204 (an impact element) is located in the chamber 202. Instead of a single projectile, plural projectiles may also be present in the chamber 202 in another embodiment. Two pressure control ports 206 and 208 are provided in the housing 200. The first control port 206 communicates or releases fluid (gas, liquid, or a combination thereof) pressure to or from the chamber 202 on the first side 210 of the projectile 204, while the second control port 208 communicates or releases fluid pressure to or from the second side 212 of the projectile 204.

The projectile 204 is powered by a fluid pressure difference between the two sides of the projectile 204. Thus, one side of the projectile 204 can be in communication with the hydrostatic pressure of wellbore fluid, while another side of the projectile 204 is in communication with an elevated pressure. The pressure difference accelerates the projectile 204 to some velocity before it impacts the wall (which is one example of a target) of the chamber 200. The length of the chamber 202 is designed so that greater than a predetermined amount of velocity can be generated for the projectile 204 before it impacts the target in the housing 200. Upon impact, a shock wave is generated in the housing 200 and transmitted to the tubing string. By reversing the pressure difference across the projectile 204, the projectile 204 can be accelerated in the other direction after impact. By repeatedly reversing the pressure differences across the projectile 204, the projectile 204 is oscillated back and forth in the chamber 204 to impart an oscillating force on the housing 200. As the shock wave is repeatedly generated from the impact and passed to the tubing string, the tubing string will vibrate, leading to friction reduction between the tubing string and the inner wall of the wellbore.

In general, the effectiveness of a vibration tool is directly related to the maximum energy the vibrator can provide. A vibrator's output energy (E) is proportional to the mass (M) and the square of the vibrator speed (V) ($E\ MV^2$). Unlike some other vibrators (denoted hereafter as "mass-based vibrators"), which rely on a heavy mass (M) to generate the vibration energy, some embodiments of the present invention use a more effective way to generate vibration energy by high impact velocity (denoted hereafter as "velocity-based vibrator"). For mass-based vibrators, the mass may be quite large (from several hundred pounds to several thousand pounds) to create an adequate amount of vibration for oilfield applications. This may cause logistic difficulty for the operators to move heavy mass into the wells, and mass-based vibrations may be prone to failure (e.g., getting stuck downhole). The velocity-based vibrator, on the other hand, uses a much smaller mass (from tens of pounds to hundreds of pounds). To create comparable amount of vibration energy, the velocity-based vibrator uses only a fraction of the mass that is needed by the mass-based vibrator. Instead of depending on a heavy mass to achieve a desired output energy, the velocity-based vibrator uses high velocity of a smaller mass to generate the desired output energy. As used here, "high velocity" refers to instantaneous velocity greater than or equal to about 2 meters per second (m/s) prior to impact. One range that can be used for the impact element is between about 2 m/s and 50 m/s. Also, a frequency of more than about 2 impacts per second may be sufficient to generate a desired output energy. One range that can be used is between about 2 impacts per second and 60 impacts per second. The significant reduction in mass for velocity-based vibrators provides better operational efficiency and safety, as it is easier to mobilize and less likely to be stuck. Although use of a heavy mass is undesirable in some instances, other embodiments may utilize the velocity-based vibrator in conjunction with a mass-based vibrator.

In the embodiment of FIG. 3, and also in the embodiments described below, the repeated impact of a projectile against targets in the vibration device generates substantial amounts of heat energy. This may raise the temperature to a level (particularly in a deep wellbore environment where temperatures may be relatively high) that may adversely affect performance of the vibration device. One way to decrease possible adverse effects of high temperature is to use components formed of a material having low coefficients of expansion with temperature, particular components within the vibration device. A further issue associated with increased temperature is build-up of fluid pressure within the vibration device, which may cause fluid to become more viscous. Pressure compensator devices may be provided in the vibration device to relieve elevated pressure conditions.

The impact force provided by the vibration device can be made to be independent of an attached heavy mass and/or the weight of the tubing string. In the embodiment of FIG. 3, the impact force is supplied by the projectile 204 in response to fluid pressure difference, and is independent of the weight of the tubing string. By adjusting the travel distance of the impact element or the fluid pressure difference, the weight of the impact element can be adjusted (in other words, the larger the distance traveled or the higher the fluid pressure difference, the lighter the impact element has to be to generate the same impact force). Also, an external anchor is not necessary in accordance with some embodiments to provide the desired vibration.

In some embodiments, the impact element, such as projectile 204, is formed of an impact-resistant and corrosion-resistant material. Examples include tungsten carbide, UNS N05500 (Monel K500), UNS N07718 (Inconel 718), and the like. Additionally, in some embodiments, the impact element and a housing or container in which the impact element is located are formed of materials having similar thermal expansion coefficients.

Figure 4A:
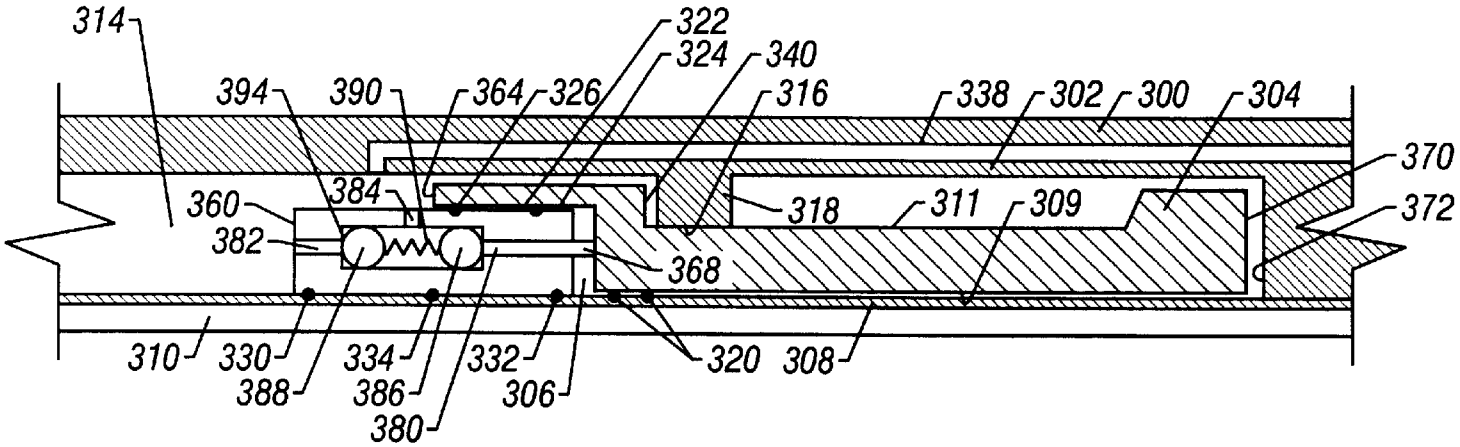
FIGS. 4A–4B is a longitudinal sectional view of a vibration device for generating a bi-directional longitudinal vibration according to one embodiment.
Figure 4B:
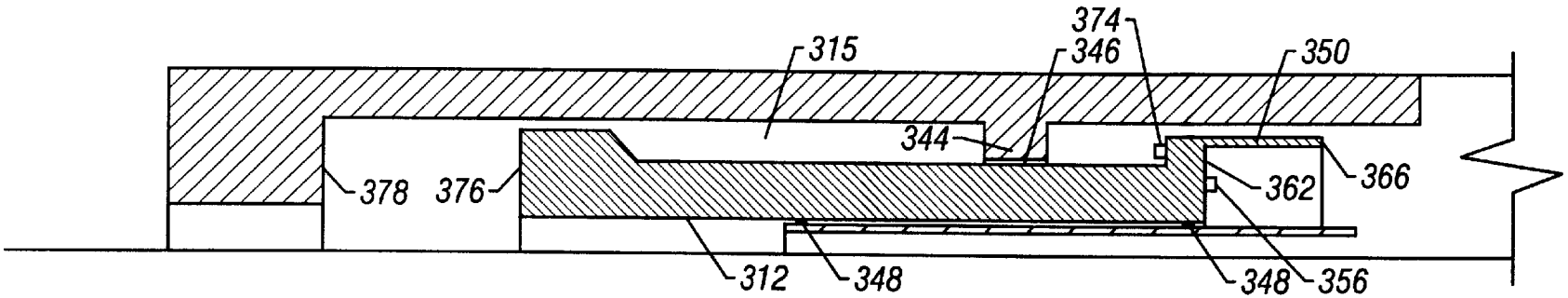

One embodiment of the device 16 shown in FIG. 3 is illustrated in greater detail in FIGS. 4A–4B. In the FIGS.

4A–4B embodiment, the vibration device 16 includes a housing 300 that defines a chamber in which an upper annular piston 304 and a lower annular piston 312 are located. As described below, the upper and lower pistons are used as projectiles to impart longitudinal vibration within the housing 300.

The outer surface 311 of the upper piston 304 is sealably engaged to a protruding portion 318 of the housing 300 by an O-ring seal 316. The inner portion 309 of the upper piston 304 is sealably engaged to a sleeve 308 by one or more O-ring seals 320. The upper portion of the piston 304 is located in a chamber 305, which can be in communication with wellbore fluids that are at hydrostatic pressure.

The sleeve 308 is moveable along the longitudinal axis of the device 16 (indicated by the arrow X). Although not shown in FIGS. 4A–4B, the sleeve 308 is operably coupled to an actuator that is adapted to move the sleeve 308 back and forth along the longitudinal axis X. The actuator can be a mechanical, electrical, or hydraulic actuator.

The lower portion of the upper piston 304 is shaped to provide an annular cylinder 322 that defines a space 324 in which a valve mechanism 310 is positioned. The valve mechanism 310 is basically a ring-shaped block that includes a release mechanism including an upper release port 380, a lower release port 382, and a side release port 384. A chamber in the block contains an upper ball 386, a lower ball 388, and a spring 390. The spring 390 pushes the balls 386 and 388 against respective upper and lower release ports 380 and 382 to block fluid flow through the release ports. However, if pressure on one side or the other is greater than pressure in the chamber 394, then the corresponding one of the balls 386 and 388 is pushed away from the respective release port to enable release of fluid pressure.

The outer surface of the ring-shaped block 310 is sealably engaged to the inner surface of the cylinder 322 by an O-ring seal 326. The inner surface of the ring-shaped block 310 is sealably engaged to the sleeve 308 by O-ring seals 330 and 332. Also, the valve mechanism 310 is fixedly attached to the sleeve 308 by an attachment element 334 (e.g., a screw, pin, etc.). Thus, when the sleeve 308 moves, the valve mechanism 310 moves along with the sleeve 308.

In the position illustrated in FIG. 4A, a chamber 306 is defined between the valve mechanism 310 and a surface 368. The space 306 is initially filled with atmospheric pressure. The atmospheric chamber 306 is sealed by seals 326, 332, and 320.

A chamber 314 below the valve mechanism 310 is filled with fluid under pressure. For example, the fluid can be pumped down a channel 338 in the housing 300. The fluid can be from a source at the well surface to provide an elevated pressure for activating the vibration device 16. The fluid in the chamber 314 is also in communication with a shoulder 340 of the upper piston 304 below the protruding portion 318 of the housing 300. Thus, if elevated pressure is applied in the chamber 314, then a pressure difference is developed across the upper piston 304 (the difference between the pressure applied on the shoulder 340 and the atmospheric pressure in the chamber 306) that tends to apply a downward force on the upper piston 304. However, if the sleeve 308 is fixed in position by the actuator, then this pressure difference does not move the upper piston 304.

In similar arrangement, an outer surface of the lower piston 312 is sealably engaged with a protruding portion 344 of the housing 300 by an O-ring seal 346. Also, the inner surface of the lower piston 312 is sealably engaged to the sleeve 308 by O-ring seals 348. The lower portion of the piston 312 is located in a chamber 315 that is in communication with wellbore fluids at hydrostatic pressure.

The upper portion of the piston 312 defines a cylinder 350, which defines a chamber 356 that is able to receive the valve mechanism 310 when the valve mechanism is moved downwardly.

In operation, to activate the vibration device 16, the actuator is activated to move the sleeve 308 downwardly, which moves the valve mechanism 310 downwardly. Because of the downward force applied on the shoulder 340 of the upper piston 304, the upper piston 304 moves downwardly with the valve mechanism 310. After the sleeve 308 has traversed a sufficient distance, the valve mechanism 310 enters the chamber 356 defined by the cylinder 350 of the lower piston 312. When the lower end 364 of the cylinder 322 of the upper piston 304 contacts the upper end 366 of the cylinder 350 of the lower piston 312, further downward movement of the upper piston 304 is prevented even as the sleeve 308 continues its downward movement. The sleeve 308 continues to move downwardly until the lower end 360 of the valve mechanism 310 contacts the bottom surface 362 of the cylinder 350.

Continued downward movement of the valve mechanism 310 when the cylinder 322 has stopped will cause the valve mechanism 310 to carry the O-ring seal 326 past the lower end 364 of the cylinder 322. This causes fluid pressure in the chamber 314 to be communicated to the upper surface 368 of the cylinder 322 to cause a sudden upward force to be applied against the upper piston 304. The pressure in the chamber 314 is set at a level that is greater than the pressure in the chamber 305 (e.g., at hydrostatic wellbore pressure), thereby creating a pressure difference and an upward force on the upper piston 304 when the pressure in the chamber 314 is communicated to the upper surface 368 of the cylinder 322. The applied force causes the upper piston 304 to be accelerated upwardly until the upper end 370 of the upper piston 304 impacts a target surface 372 defined by the housing 300. More generally, the target can be some other type of object that is fixedly attached to the housing 300. When impact occurs, a compressive wave is generated and passed to the tubing string, resulting in a vibrational motion of the tubing string.

Once the valve mechanism 310 enters the chamber 356 and the seal 326 carried by the valve mechanism 310 engages the inner wall of the cylinder 350, the buildup of pressure in the chamber 356 is relieved through the check valve provided by the ball 388 and the release port 382.

At this point, the valve mechanism 310 is sitting in the chamber 356. The actuator is then activated to move the sleeve 308 upwardly, which causes the valve mechanism 310 to move upwardly along with the sleeve 308. As a result, a pressure difference is developed across the lower piston 312 (between the elevated pressure in chamber 314 and the wellbore fluid pressure in the region of the chamber 356 between the valve mechanism 310 and the bottom surface 362). The differential pressure applies a net upward force against a shoulder 374 of the lower piston 312. Thus, as the valve mechanism 310 is moved upwardly, the lower piston 312 follows due to the force applied on the shoulder 374. The upward movement of the valve mechanism 310 and lower piston 312 continues until the upper end 366 of the cylinder 350 contacts the lower end 364 of the upper cylinder 322, which stops further upward movement of the lower piston 312. However, the valve mechanism 310 continues its upward motion until the seal 326 clears the upper end 366 of the lower cylinder 350. Again, any pressure buildup in the chamber 306 is relieved through the check valve provided by the ball 386 and the release port 380.

When the seal 326 clears the upper end 366 of the lower cylinder 350, the elevated fluid pressure in the chamber 314 rushes into the chamber 356 of the lower cylinder 350 to apply downward pressure on the bottom surface 362. A pressure differential is created across the lower piston 312 (difference between the pressure applied on the surface 362 and the wellbore fluid pressure applied against the lower piston 312 in the chamber 315). As a result, the downward force accelerates the lower piston 312 downwardly until the lower end 376 of the lower piston 312 impacts a target surface 378 attached to the housing 300. As a result of the impact, a tensile wave is generated in the housing 300. The tensile wave is propagated to the tubing string, resulting in a vibrational motion of the tubing string.

Continued up and down motion of the sleeve 308 by the actuator will cause the upper and lower pistons to be accelerated in opposite directions to provide oscillating back and forth impact forces to provide the desired bidirectional longitudinal vibration.

The effectiveness of the impact induced vibration on tubing string is directly related to the frequency spectrum of the impact force. In order to maximize the impact induced vibration on the tubing string, the frequency spectrum of the impact force should be adjusted according to tubing length and downhole conditions. The tubing length and downhole conditions affect the transmissibility of the tubing string into the wellbore. There are several ways to change the impact force frequency spectrum. For example, the impact force spectrum can be changed by altering the back pressure in the chamber 314 of FIG. 4A. Increasing the back pressure in chamber 314 will lead to lower frequency components of the impact force spectrum, a condition that is favorable for better transmissibility. Another way to change the frequency spectrum is by adjusting the movement of sleeve 308. Adjustments to the movement of the sleeve 308 that alter the frequency spectrum include adjusting the speed of the up and down movement of the sleeve 308, and introducing a time delay at the end of upward movement or downward movement of the sleeve 308 (e.g., at the end of the upward movement, the sleeve 308 stops for a certain amount of time before moving downward). Another way to change the frequency spectrum of the impact force is by adjusting the traveling distance of the impacting elements, such as by adjusting the length of chamber 314. Still another way to change the frequency spectrum of the impact force is by choosing suitable materials for impact surfaces.

It should be noted that all of the above-mentioned ways (except material selection) of changing the frequency spectrum can be employed dynamically as conditions downhole necessitate.

Figure 5A:
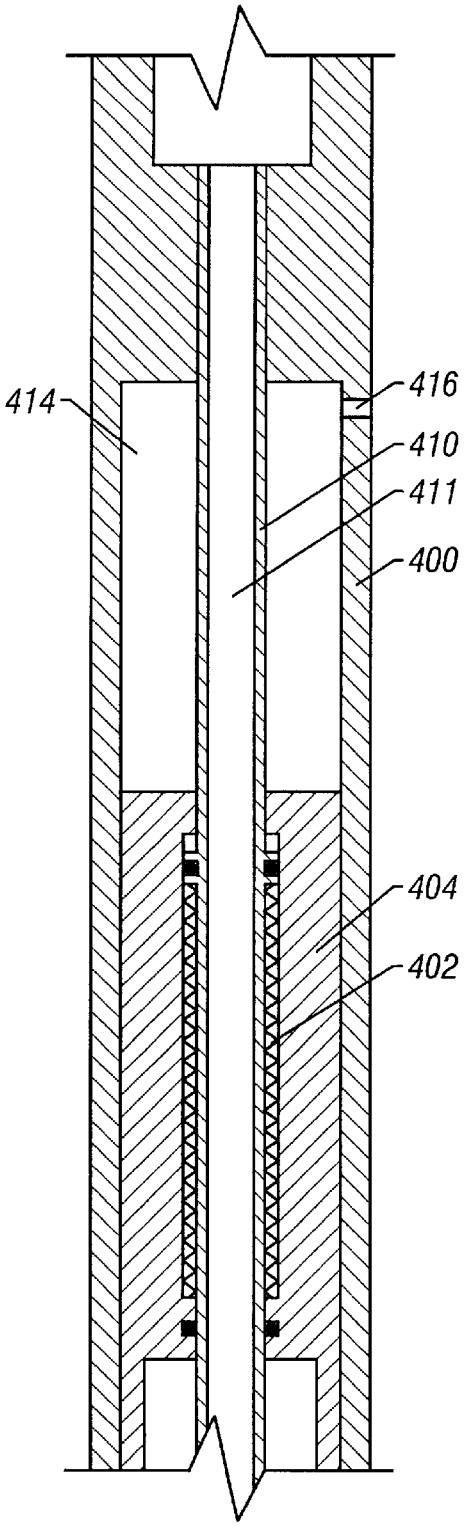
FIGS. 5A–5C are a longitudinal sectional view of a vibration device for generating a bi-directional vibration according to another embodiment.
Figure 5B:
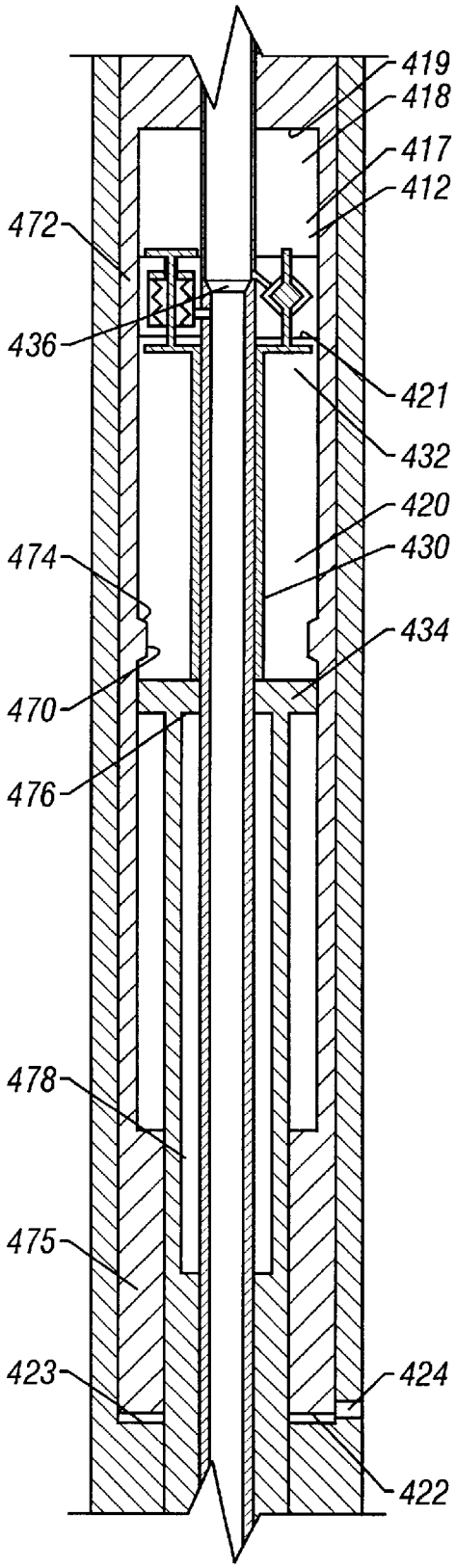
Figure 5C:
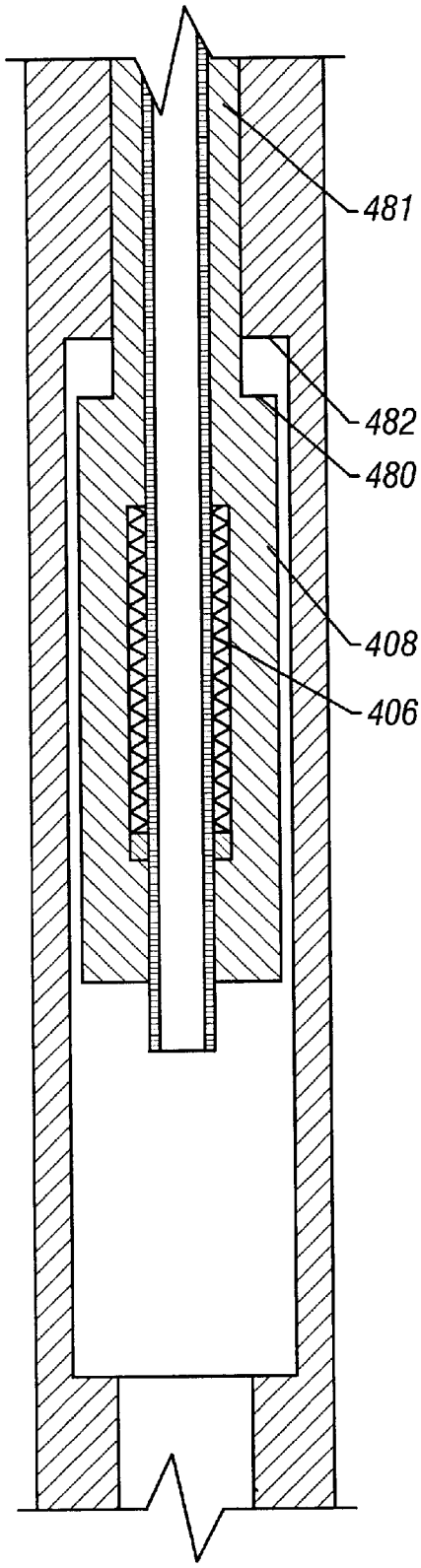

Referring to FIGS. 5A–5C, another embodiment of the vibration device 16 that provides for bi-directional longitudinal vibration is illustrated. In this embodiment, an upper spring 402 (FIG. 5A) and a lower spring 406 (FIG. 5C) provides the force for accelerating an upper hammer 404 and a lower hammer 408, respectively, to cause an impact force between the hammers 404 and 408 and a corresponding target that is fixedly attached to a housing 400 of the vibration device 16.

The upper hammer 404 has a sleeve 472 that extends downwardly inside the housing 400. An inwardly protruding portion is formed on the sleeve 472. The lower end of the sleeve 472 is integrally attached to an impact portion 475 that has an impact surface 422. The impact surface 422 is designed to impact a shoulder 423 of the housing 400. The space between the impact surface 422 and shoulder 423 is in communication with wellbore fluid pressure through one or more side ports 424.

The lower hammer 408 (FIG. 5C) also defines an impact shoulder 480 that is designed to impact a shoulder 482 of the housing 400. The space between the impact shoulder 480 and the shoulder 482 is also in communication with wellbore fluid pressure. A sleeve portion 481 of the lower hammer 408 extends upwardly in the housing 400 to an upper end portion 434.

The vibration device 16 also includes a mandrel 410 and a valve mechanism 412. An annular piston 430 is arranged around the mandrel 410, with the upper end of the piston 430 having a flanged portion 432.

An annular chamber 418 is defined between the lower surface of a shoulder 419 of the upper hammer 404 and the upper end 417 of the valve mechanism 412. Another chamber 420 is defined between the upper end portion 434 of the lower hammer 408 and the lower end 421 of the valve mechanism 412. The valve mechanism 412 selectively controls fluid flow from the inner bore 411 of the mandrel 410 to one of the chambers 418 and 420.

A ball seat 436 is provided in the inner bore 411 of the mandrel 410, with the ball seat 436 adapted to receive a ball dropped from the surface. When the ball is seated in the ball seat 436, fluid pressure can be increased in the mandrel bore 411 to generate movement of the hammers 404 and 408 (as further described below).

Figure 6:
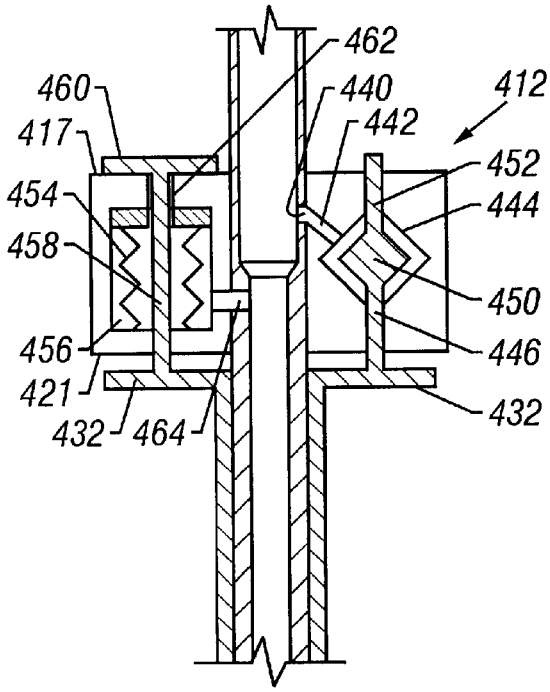
FIG. 6 illustrates a valve mechanism used in the vibration device of FIGS. 5A–5C.

The valve mechanism 412 is illustrated in greater detail in FIG. 6. The valve mechanism 412 includes a channel 442 that is in communication with the mandrel bore 411 through a port 440 in the mandrel 410. When the ball is seated in the ball seat 436, fluid flow in the mandrel bore 411 flows through the port 440 and channel 442 to a longitudinal channel 452 having an enlarged space 444 capable of receiving an enlarged portion 450 (forming a sealing element) of a rod 446. The lower end of the rod 446 is fixedly or integrally attached to the flanged portion 432 of the piston 430.

In the illustrated position of FIG. 6, fluid flowing into the space 444 goes upwardly through the channel 452 into the chamber 418. In its down position, the sealing element 450 of the rod 446 is sealably engaged with the lower surface defining the space 444 to prevent fluid flow down the channel 452. The seal can be created by use of an O-ring seal or coating the sealing element 450 with a suitable material. If the sealing element 450 of the rod 446 is moved upwardly to sealably engage an upper surface defining the space 444, then fluid flows downwardly through the channel 452 into the chamber 420.

Another part of the valve mechanism 412 includes a spring 454 that is placed in a chamber 456. The spring 454 is biased to ensure that in a pressure balance situation (before the drop of a ball), the valve mechanism 412 is in a position such that fluid that enters into port 440 is in communication with chamber 418, while fluid in chamber 420 is in communication with the wellbore through port 464. The plate 460 has a sealing element such that when the plate 460 is in contact with upper surface 417 of the valve mechanism 412, there is no fluid communication between chamber 418 and the channel 462. Similarly, the flanged portion 432 also has a sealing element to ensure that when it is in contact with the lower surface 421 of the valve mechanism 412, there is no fluid communication between the lower chamber 420 and the channel 462.

A rod 458 is attached to the flanged portion 432 of the piston 430. The upper end of the rod 458 is connected to a plate 460. The plate 460, rod 458, and the flanged portion 432 can be a single integral member, or alternatively, they can be separate pieces that are fixedly attached. The rod 458 is moveable up and down in a channel 462 defined in the valve mechanism 412.

In operation, a ball dropped into the mandrel bore 411 lands on the ball seat 436 to create a seal. Fluid is then flowed down the mandrel bore 411, which enters the port 440 (FIG. 6) into the channel 442 and longitudinal channel 452 and out into the upper chamber 418. The increase in pressure in the chamber 418 creates a differential pressure with respect to the wellbore fluid pressure in the chamber 414, which causes the upper hammer 404 to move up with respect to the mandrel 410. As the upper hammer 404 moves upwardly, the spring 402 is compressed. The sleeve 472 extending below the upper hammer 404 has the inwardly protruding portion 470. When the upper hammer 404 moves up a predetermined distance, a shoulder 474 on the protruding portion 470 makes contact with the flanged portion 432 of the piston 430. Further upward movement of the hammer 404 causes the piston 430 to also move upwardly.

Upward movement of the hammer 404 moves the rod 458 and plate 460 (FIG. 6) upwardly, thereby allowing fluid in the upper chamber 418 to flow through channel 462 and the port 464 into the mandrel bore 411 below the ball seat 436. This flow of fluid from the upper chamber 418 causes a sudden loss of pressure in the upper chamber 418, which allows the compressed upper spring 402 to drive the upper hammer 404 downwardly with respect to the mandrel 410. The spring 402 drives the upper hammer 404 downwardly until the lower surface 422 of the hammer 404 impacts a shoulder 423 of the housing 400. The impact creates a tensile wave within the housing 400, which travels upward into the tool string.

When the sealing element 450 in the chamber 444 is in its up position, fluid flow through the mandrel bore 411 above the ball seat 464 is now sealed from the upper chamber 418. The mandrel bore fluid flows through the port 440, channel 442, and channel 452 into the lower chamber 420. The increase in the pressure of the chamber 420 exerts a downward force on the upper end portion 434 of the lower hammer 408. This causes the lower hammer 408 to move downwardly, which compresses the spring 406. When the lower hammer 408 moves down by a certain distance, a shoulder 476 defined at the lower surface of the portion 434 of the lower mandrel 408 makes contact with a shoulder 478 defined at a lower portion of the piston 430. Further downward movement of the lower hammer 408 causes the piston 430 to also be pulled downwardly.

The downward movement of the piston 430 pulls along with it rods 458 and 446. As a result, fluid flow into the lower chamber 420 stops, while fluid communication is again established between the lower chamber 420 and the channel 462 in the valve mechanism 412. The fluid flows from the lower chamber 420 through the channel 462 and port 464 into the mandrel bore 411. This results in a sudden loss of pressure from the lower chamber 420 into the mandrel bore 411 below the ball seat 436. As a result, the spring 406 is able to drive the lower hammer 408 in an upwardly direction. When the lower hammer 408 moves upwardly by a predetermined distance, the impact shoulder 480 of the hammer 408 (FIG. 5C) impacts the shoulder 482 of the housing 400. This impact creates a compressive wave within the housing 400, which travels upwardly into the tubing string.

The process described above is repeated as long as an elevated pressure is provided by fluid flow down the mandrel bore 411 above the ball that is seated in the ball seat 436. This enables oscillation of the upper and lower hammers and respective impacts between the upper hammer 404 and the housing 400 and the lower hammer 408 and the housing 400.

Figure 7:
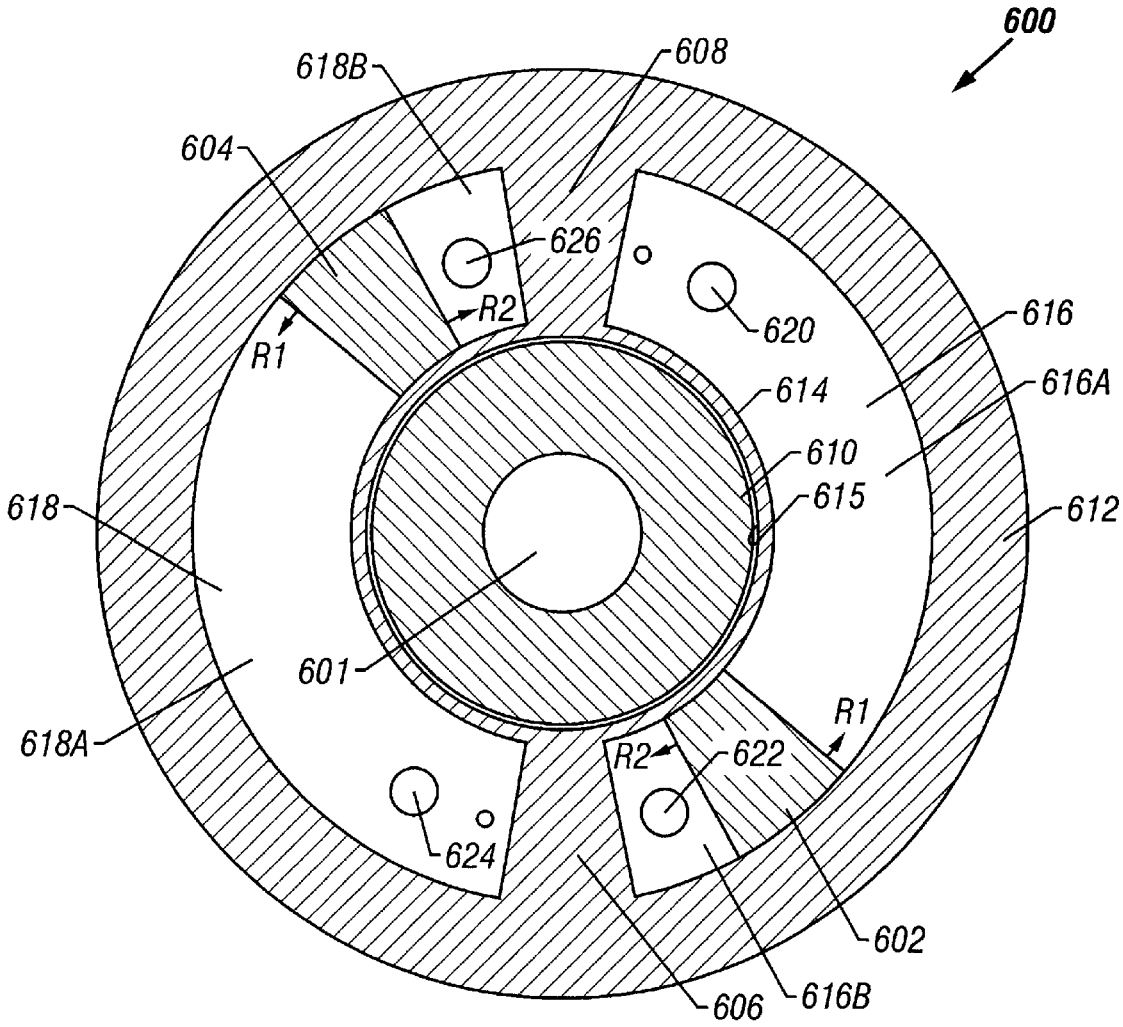
FIGS. 7–10 illustrates an apparatus to generate a rotational or torsional vibration in the tubing string of FIG. 1, in accordance with another embodiment.

In another embodiment, the vibration devices 16A and 16B used in the tubing string of FIG. 1 provide rotational or torsional vibrations on the tubing string. FIG. 7 shows a cross-sectional view of a rotational or torsional vibration device (having reference numeral 600). The rotational vibration is caused by impact between a pair of impactors 602, 604 coupled to a spindle mandrel 610 and a pair of connector members 606, 608. The impactors 602, 604 are fixedly mounted to the spindle mandrel 610, which is rotatable with respect to an outer housing 612 and an inner housing 614 of the rotational vibration device 600. The connector members 606, 608 connect the inner and outer housings 614 and 612.

In response to fluid differential pressure in a first direction, the spindle mandrel 610 rotates in a first rotational direction to impact the connector members 606, 608. Then, in response to fluid differential pressure in the opposite direction, the spindle mandrel 610 rotates in the opposite rotational direction to cause the impactors 602, 604 to impact connector members 606, 608.

The connector members 606 and 608 extend generally along the longitudinal axis of the vibration device 600. As a result, the connector members 606, 608 define two chambers 616 and 618. In addition, the impactor 602 divides the chamber 616 into two portions: a first portion 616A and a second portion 616B. Similarly, the impactor 604 divides the chamber 618 into two portions: a first portion 618A and a second 618B.

Four ports lead into the respective chamber portions. A first port 620 leads into chamber 616A, a second port 622 leads into chamber portion 616B, a third port 624 leads into chamber portion 618A, and a fourth port 622 leads into chamber portion 618B. As described below, an upper set of the ports 620, 622, 624, and 626 are located at the upper end of the vibration device 600, while a lower set of the ports 620, 622, 624, and 626 are located at the lower end of the vibration device 600.

The ports 620, 622, 624, and 626 are selectably opened and closed to enable communication of fluid pressure into respective chambers 616A, 616B, 618A, and 618B. By controlling which ports are open and which ones are closed, a differential pressure in the desired rotational direction can be produced across the impactors 602, 604 to cause a desired rotational movement of the spindle mandrel 610. By continuously rotating the impactors 602, 604 back and forth to impact the connector members 606, 608, rotational vibration is imparted onto the tubing string that is connected to the vibration device 600.

Ports 622 and 626 are opened and ports 620 and 624 are closed to enable communication of an elevated fluid pressure into chambers 616B and 618B, while chambers 616A and 618A remain at a lower pressure (e.g., wellbore hydrastatic pressure). The differential pressure created between chambers 616B and 616A and between chambers 618B and 618A causes the spindle mandrel 610 and the impactors 602, 604 to rotate in a direction indicated by arrows R1.

In contrast, to rotate the impactors 602, 604 in the other direction (indicated by arrows R2), the ports 620 and 624 are opened while the ports 622 and 626 are closed. An elevated fluid pressure can then be pumped into the chambers 616A and 618A to create the differential pressures to move the impactors 602, 604 in direction R2.

Figure 8:
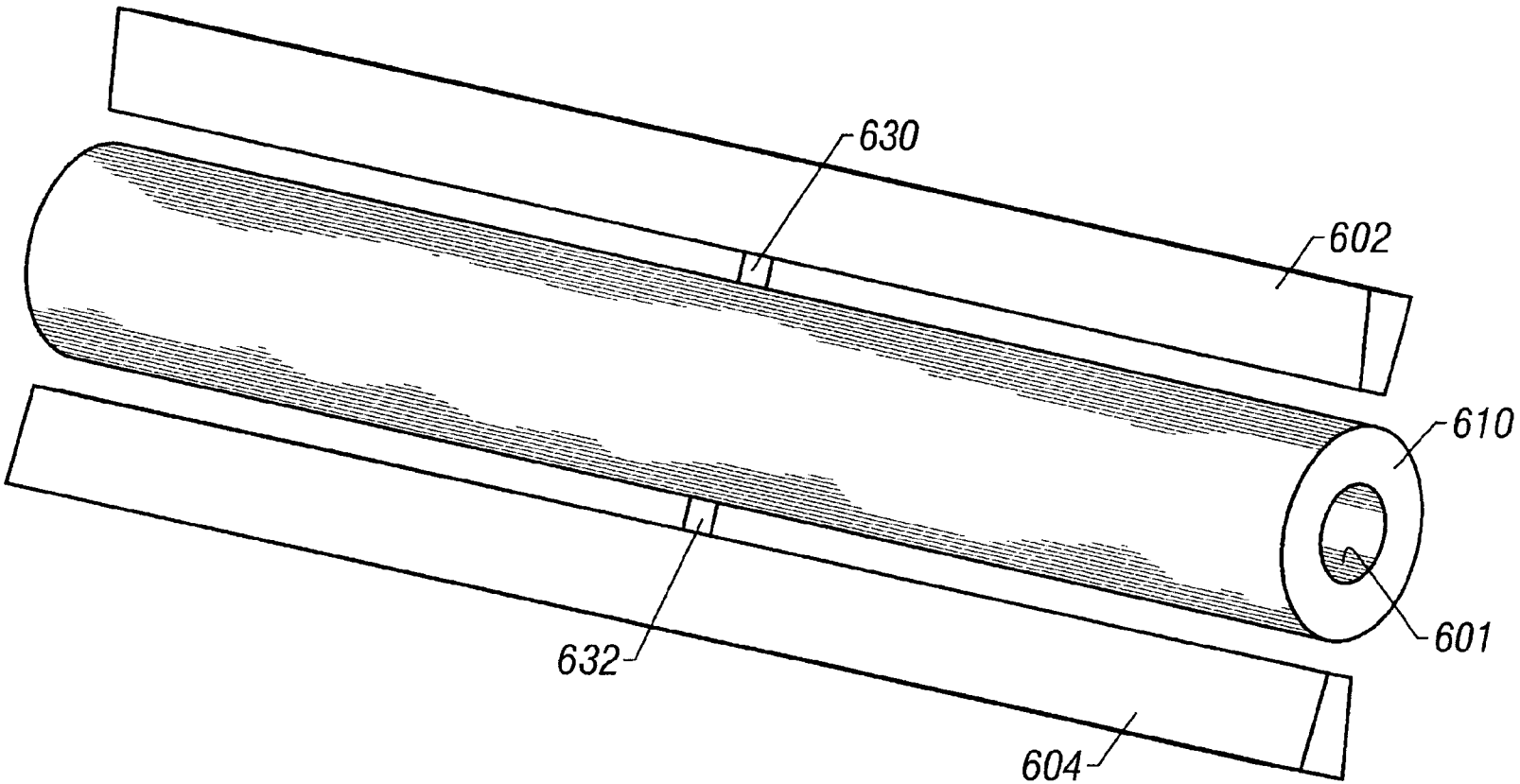

Referring to FIG. 8, a perspective view of the spindle mandrel 610 and impactors 602 and 604 are illustrated. The impactors 602 and 604 are attached to the spindle mandrel 610 by respective connectors 630 and 632. The connectors 630 and 632 may be in the form of pins or other attachment mechanisms.

Figure 9:
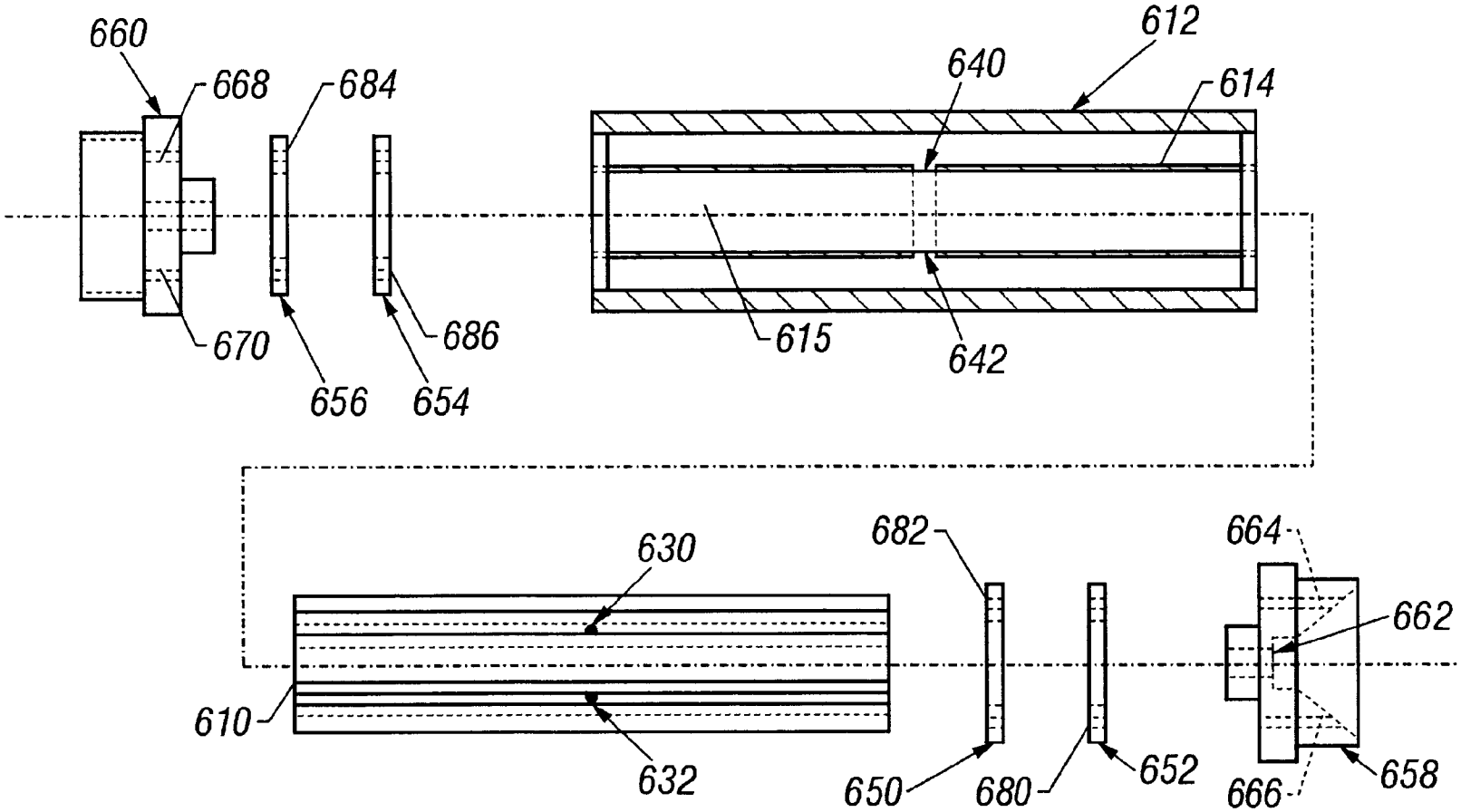

Referring to FIG. 9, an exploded longitudinal sectional view of the vibration device 600 is illustrated. The inner housing 614 of the rotational vibration device 600 includes a longitudinal bore 615 into which the spindle mandrel 610 can be positioned. The pins 630 and 632 that attach the spindle mandrel 610 to respect impactors 602 and 604 are fitted through openings 640 and 642 in the inner housing 614. As shown in FIG. 9, the impactors 602 and 604 are designed to fit into the space between the inner and outer housings 614 and 612.

Sliders 650 and 652 are positioned at one end of the vibration device 16, while sliders 654 and 656 are provided at the other end of the vibration device 16. The sliders are generally semicircular in shape so that each pair of sliders are arranged in generally the same plane. Each slider is less than 180° semicircular (e.g., 170° semicircular) to provide room for the sliders to slide on the same plane. The sliders 650, 652, 654, and 656 provide each set of ports 620, 622, 624, and 626 at the upper and lower ends of the vibration device 600. The ports 620, 622, 624, and 626 are opened or closed based on the positions of the sliders.

In addition, a first valve mechanism 658 cooperates with the sliders 650 and 652 to communicate fluid through the sliders 650 and 652 into the first end of the vibration device 16, while a second valve mechanism 660 cooperates with the sliders 654 and 656 to communicate fluid into the second end of the vibration device 16.

In cooperation with the valve mechanism 658, the rotational slider 652 controls the selected opening and closing of fluid communication between the chamber 616A and the tubing string and between the chamber 616B and the tubing string. Similarly, the rotational slider 650 controls the selective opening and closing of fluid communication between the chamber 618B and the tubing string and between the chamber 618A and the tubing string.

The valve mechanism 658 has a ball seat 662 adapted to receive a ball. The valve mechanism 658 also includes a first channel 664 and a second channel 666. The sliders 650 and 652 have openings (FIG. 10) that are selectively aligned with the channels 664 and 666 to enable communication of fluid through the valve mechanism 658 through the openings in the sliders to one of the chambers 616A, 616B, 618A, and 618B.

In conjunction with the valve mechanism 660, the rotational slider 656 controls the selective opening and closing of fluid communication between the chamber 616A and a region below the vibration device 600 (such as a tool connected below the device 600 or an annular region below the device 600). The slider 656 also controls the selective opening and closing of fluid communication between the chamber 616B and the region below the vibration device 600. Similarly, the rotational slider 654 controls the selective opening and closing of fluid communication between the chamber 618B and the region below the vibration device 600, and fluid communication between the chamber 618A and the lower region.

The valve mechanism 660 includes a first channel 668 and a second channel 670 that are selectively alignable with the ports of the sliders 654 and 656. The sliders 650, 652, 654, and 656 are movable rotationally by actuation pins 680, 682, 684, and 686, respectively. The actuation pins 680, 682, 684, and 686 are engageable by the impactors 602 and 604 as the impactors 602 and 604 rotate.

Figure 10:
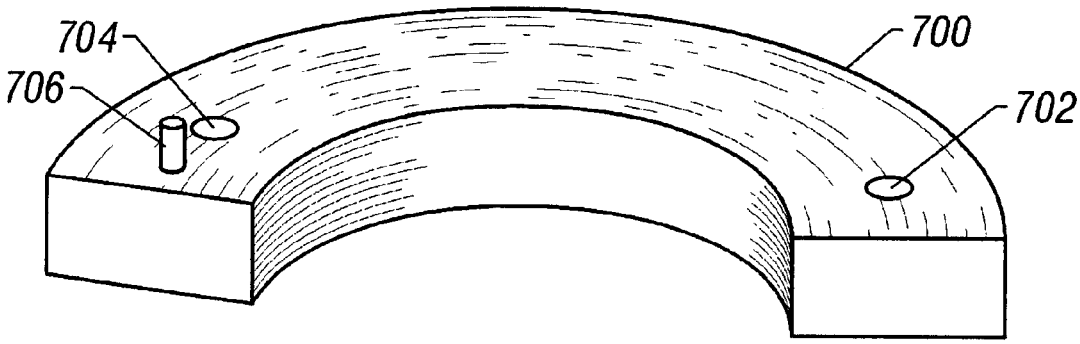

As shown in FIG. 10, each slider 700 (corresponding to one of sliders 650, 652, 654, and 656) is generally semicircular (slightly less than semicircular) in shape. As a result, two rotational sliders can be placed side by side to form generally a circle. Each slider 700 includes a first port 702 and a second port 704. In addition, the slider 700 includes an actuation pin 706 (corresponding to one of pins 680, 682, 684, and 686) that when engaged by the impactor 602 or 604 causes the rotational slider 700 to rotate a predetermined angle. Rotation of the slider 700 causes the port 702 and 704 to move, thereby enabling the port 702 and 704 to move relative to channels in the valve mechanism 658 or 660.

During normal operation, when torsional vibration is not needed, the vibration device 600 is used as a fluid conduit. Fluid flows from the tubing string through the central bore 601 of the hollow spindle mandrel 610. However, when torsional vibration is desired, a ball is dropped into the string for landing onto the ball seat 662 in the valve mechanism 658. The initial settings of the rotational sliders 650 and 652 are such that the top of chambers 616A and 618A are in fluid communication with the fluid from the tubing string through the valve mechanism 658. However, the chambers 616A and 618A are isolated from the region below the vibration device 600 by the rotational sliders 654 and 656.

On the other hand, the chambers 616B and 618B are in fluid communication with the region below the vibration device 600, while the chambers 616B and 618B are isolated from the tubing string by the rotational sliders 650 and 652.

When pressure is increased in the tubing string, a differential pressure is created between chambers 616A and 616B and between chambers 618A and 618B. As a result, the spindle mandrel 610 is rotationally accelerated by the differential pressure in the direction indicated by arrows R2 (FIG. 7).

The impactors 602, 604 are rotated until impact occurs between the impactors 602, 604 and connector members 606, 608. However, just before the clockwise impact occurs, the impactors 602, 604 engage actuation pins 680, 682, 684, and 686 of respective rotational sliders 650, 652, 654, and 656 to shift their rotational positions. As a result, a different set of the openings in the sliders are aligned with the channels in the valve mechanisms 658 and 660 so that a different combination of the ports 620, 622, 624, and 626 are opened and closed. In this second position, the increased pressure in the tubing string causes the spindle mandrel 610 to rotate in the opposite direction (indicated by arrows R1, as shown in FIG. 7). This causes the impactors 602, 604 to impact the connector members 606, 608 in the opposite direction. Right before impact, the impactors 602, 604 engage the actuation pins of the rotational sliders 650, 652, 654, and 656 to again shift the rotational sliders to the initial position. Thus, by maintaining the tubing pressure at an elevated level, the spindle mandrel 610 is rotated back and forth to cause back and forth impact between the impactors 602, 604 and the connector members 606, 608. As a result, a relatively continuous, rotational vibration is imparted on the tubing string.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An apparatus for use in a wellbore, comprising:

a housing having a longitudinal axis; and a mechanism comprising a first impact element having a first actuation surface, and a second impact element having a second actuation surface, the impact elements adapted to move along the longitudinal axis in an oscillating manner to impart a back and forth force on the housing to vibrate the housing, the mechanism further comprising a pressure chamber containing an elevated pressure to drive the first and second impact elements in the housing, and a valve assembly to communicate the elevated pressure to one of the first and second actuation surfaces at one time; wherein the first impact element comprises a first receiving chamber adapted to receive the valve assembly; and wherein the valve assembly is adapted to prevent communication of the elevated pressure to the first actuation surface when positioned in the first receiving chamber.

2. The apparatus of claim 1, wherein the valve assembly comprises a seal adapted to engage the first receiving chamber to isolate the first actuation surface.

3. The apparatus of claim 1, wherein the valve assembly comprises a check valve element to relieve pressure from a region adjacent the first actuation surface.

4. The apparatus of claim 1, wherein the second impact element comprises a second receiving chamber adapted to receive the valve assembly, the valve assembly adapted to prevent communication of the elevated pressure to the second actuation surface when positioned in the second receiving chamber.

5. The apparatus of claim 4, further comprising a member attached to the valve assembly, the member adapted to move the valve assembly between the first receiving chamber and the second receiving chamber.

6. The apparatus of claim 4, wherein the elevated pressure is communicated to one of the first and second actuation surfaces when the valve assembly is removed from the corresponding one of the first and second receiving chambers.

7. The apparatus of claim 1, wherein the apparatus is adapted for vibrating a string, and wherein the mechanism is adapted to oscillate the impact elements at a frequency corresponding to a resonant frequency of the string.

8. The apparatus of claim 1, wherein the apparatus is adapted to vibrate a string, and wherein the mechanism is adapted to oscillate the impact elements at a frequency corresponding to the transmissibility of the string in the wellbore.

9. The apparatus of claim 8, wherein the oscillating frequency is dynamically adjustable to correspond to varying transmissibility of the string in the wellbore.

10. The apparatus of claim 1, wherein the mechanism provides a differential pressure across each of the impact elements to move the impact elements.

11. The apparatus of claim 10, wherein the differential pressure is variable to vary a frequency of oscillation of each of the impact elements.

12. The apparatus of claim 1, wherein the mechanism defines a length of travel for each of the impact elements.

13. The apparatus of claim 12, wherein the length is variable to control an impact force supplied by each of the impact elements.

14. The apparatus of claim 1, further comprising a shock absorber to protect components of a string from vibration induced by the mechanism.

15. An apparatus for use in a wellbore comprising:

a housing having a longitudinal axis; and a mechanism having a plurality of impact elements and a plurality of springs each engaged to a corresponding impact element, the impact elements adapted to move along the longitudinal axis in an oscillating manner to impart a back and forth force on the housing to vibrate the housing, and the springs providing forces to move the impact elements.

16. The apparatus of claim 15, wherein the mechanism further comprises a first chamber containing an elevated pressure to oppose the force applied by a first spring.

17. The apparatus of claim 16, wherein the mechanism further comprises a valve mechanism to remove the pressure from the first chamber to enable the first spring to move a first impact element.

18. The apparatus of claim 17, wherein the mechanism further comprises a second chamber containing an elevated pressure to oppose the force applied by a second spring.

19. The apparatus of claim 18, wherein the valve mechanism is adapted to remove the pressure from the second chamber to enable the second spring to move a second impact element.

20. The apparatus of claim 19, further comprising a conduit to deliver the elevated pressure to the first and second chambers.

21. The apparatus of claim 20, wherein the valve mechanism is adapted to selectively communicate the elevated pressure from the conduit to one of the first and second chambers.

22. An apparatus for use in a wellbore comprising:

a housing having a longitudinal axis; and a mechanism having one or more impact elements adapted to move along the longitudinal axis in an oscillating manner to impart a back and forth force on the housing to vibrate the housing, and wherein the impact elements are formed of a material having a low coefficient of thermal expansion.

23. The apparatus of claim 22, wherein the impact elements are formed of an impact-resistant and corrosion-resistant material.

* * * * *